US005464071A

United States Patent [19]

Rice et al.

[11] Patent Number: 5,464,071

[45] Date of Patent: Nov. 7, 1995

[54] LADDER LEVELING DEVICE

[76] Inventors: Crispin J. Rice, 1093 Ballston Lake Rd., Ballston Lake, N.Y. 12019-2331; William G. Hauprich, 249 Malta Ave., Ballston Spa, N.Y. 12020

[21] Appl. No.: 373,608

[22] Filed: Jan. 17, 1995

[51] Int. Cl.[6] ..... E06C 7/44

[52] U.S. Cl. ..... 182/205; 182/111

[58] Field of Search ..... 182/200–205, 182/107–111; 248/188.2

[56] References Cited

U.S. PATENT DOCUMENTS 2,503,626 4/1950 Mayberry ..... 182/111 X
5,263,699 11/1993 Phoumisavanh ..... 248/188.2

*Primary Examiner*—Alvin C. Chin-Shue

[57] ABSTRACT

A new and improved ladder leveling device comprising a gear box having a plurality of gears coupled to an interior of the gear box on shafts. The shaft of a lowest gear extends outwardly of the gear box. A crank couples with the outwardly extending shaft of the lowest gear. The crank serves to rotate the lowest gear thereby collectively rotating the plurality of gears. A pin selectively couples with an uppermost gear and extends outwardly of the left wall. The pin serves to selectively engage or disengage the three gears. A plate is secured to a lower portion of the gear box. The plate serves to support the ladder's leg. Included in the device is a vertical rack having a plurality of teeth thereon. The vertical rack is secured within the gear box. The plurality of teeth engage the plurality of gears and are optionally raised or lowered by the rotation of the gears when the pin is disengaged. A foot pad is pivotally coupled with the vertical rack. The foot pad serves to lie flat on the ground and stabilize the device. An adjustable clamp is secured to the a wall of the gear box upwardly of the plate. The clamp serves to secure the ladder's leg against the gear box.

3 Claims, 4 Drawing Sheets

LADDER LEVELING DEVICE

BACKGROUND OF THE INVENTION

1. Field of the Invention

The present invention relates to a ladder leveling device and more particularly pertains to adjusting the length of a ladder's leg to keep the ladder vertical on uneven ground with a ladder leveling device.

2. Description of the Prior Art

The use of leveling devices is known in the prior art. More specifically, leveling devices heretofore devised and utilized for the purpose of leveling ladders are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,107,958 to Johnson discloses a ladder leveler.

U.S. Pat. No. 5,064,024 to Barham discloses a ladder leg extender apparatus with improved vertical adjustment means.

U.S. Pat. No. 4,993,514 to Ferguson discloses a ladder levelling device.

U.S. Pat. No. 4,766,976 to Wallick,Jr. discloses a ladder extender and leveler.

U.S. Pat. No. 4,069,890 to Gottliebsen discloses a device for leveling a ladder.

While these devices fulfill their respective, particular objective and requirements, the aforementioned patents do not describe a ladder leveling device for adjusting the length of a ladder's leg to keep the ladder vertical on uneven ground.

In this respect, the ladder leveling device according to the present invention substantially departs from the conventional concepts and designs of the prior art, and in doing so provides an apparatus primarily developed for the purpose of adjusting the length of a ladder's leg to keep the ladder vertical on uneven ground.

Therefore, it can be appreciated that there exists a continuing need for new and improved ladder leveling device which can be used for adjusting the length of a ladder's leg to keep the ladder vertical on uneven ground. In this regard, the present invention substantially fulfills this need.

SUMMARY OF THE INVENTION

In the view of the foregoing disadvantages inherent in the known types of leveling devices now present in the prior art, the present invention provides an improved ladder leveling device. As such, the general purpose of the present invention, which will be described subsequently in greater detail, is to provide a new and improved ladder leveling device and method which has all the advantages of the prior art and none of the disadvantages.

To attain this, the present invention essentially comprises a gear box having an upper end, a lower end, a right wall and a left wall. A receiving aperture is formed through the upper end and the lower end. Three gears are coupled to an interior of the gear box on shafts. The shaft of a lowest gear extends outwardly of the left wall. A crank couples with the outwardly extending shaft of the lowest gear. The crank serves to rotate the lowest gear thereby collectively rotating the three gears. A pin selectively couples with an uppermost gear and extends outwardly of the left wall. The pin serves to selectively engage or disengage the three gears. A plate is secured to the a lower portion of the right wall. The plate serves to support the ladder's leg. The device contains a vertical rack having a first end, a second end, an intermediate extent therebetween, a front surface and a back surface. The front surface of the intermediate extent has a plurality of teeth thereon. The vertical rack is secured within the receiving aperture formed through the upper end and the lower end of the gear box. The plurality of teeth engage the three gears and are optionally raised or lowered by the rotation of the three gears when the pin is disengaged. A foot pad is pivotally coupled with the second end by a bolt and wing nut. The foot pad serves to lie flat on the ground and stabilize the device. The device contains an adjustable clamp having an outer wall. The outer wall has four inwardly extending posts therefrom. The posts are secured to the right wall of the gear box upwardly of the plate. The outer wall has a threaded aperture formed therethrough. A crank shaft is rotatably coupled with the threaded aperture of the outer wall. The crank shaft has a first end and a second end. The first end has a crank handle theresecured. The adjustable clamp has a movable side wall. The movable side wall is slidably coupled with the four inwardly extending posts. The movable side wall also is secured to the second end of the crank shaft. The movable side wall serves to secure the ladder's leg against the gear box.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved ladder leveling device which has all the advantages of the prior art leveling devices and none of the disadvantages.

It is another object of the present invention to provide a new and improved ladder leveling device which may be easily and efficiently manufactured and marketed.

It is a further object of the present invention to provide a new and improved ladder leveling device which is of durable and reliable construction.

An even further object of the present invention is to provide a new and improved ladder leveling device which is susceptible of a low cost of manufacture with regard to both materials and labor, and which accordingly is then susceptible of low prices of sale to the consuming public, thereby making such a ladder leveling device economically available to the buying public.

Still yet another object of the present invention is to provide a new and improved ladder leveling device which provides in the apparatuses and methods of the prior art some of the advantages thereof, while simultaneously overcoming some of the disadvantages normally associated therewith.

Even still another object of the present invention is to provide a new and improved ladder leveling device for adjusting the length of a ladder's leg to keep the ladder vertical on uneven ground.

Lastly, it is an object of the present invention to provide a new and improved ladder leveling device comprising a gear box having a plurality of gears coupled to an interior of the gear box on shafts. The shaft of a lowest gear extends outwardly of the gear box. A crank couples with the outwardly extending shaft of the lowest gear. The crank serves to rotate the lowest gear thereby collectively rotating the plurality of gears. A pin selectively couples with an uppermost gear and extends outwardly of the left wall. The pin serves to selectively engage or disengage the three gears. A plate is secured to a lower portion of the gear box. The plate serves to support the ladder's leg. Included in the device is a vertical rack having a plurality of teeth thereon. The vertical rack is secured within the gear box. The plurality of teeth engage the plurality of gears and are optionally raised or lowered by the rotation of the gears when the pin is disengaged. A foot pad is pivotally coupled with the vertical rack. The foot pad serves to lie flat on the ground and stabilize the device. An adjustable clamp is secured to a wall of the gear box upwardly of the plate. The clamp serves to secure the ladder's leg against the gear box.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
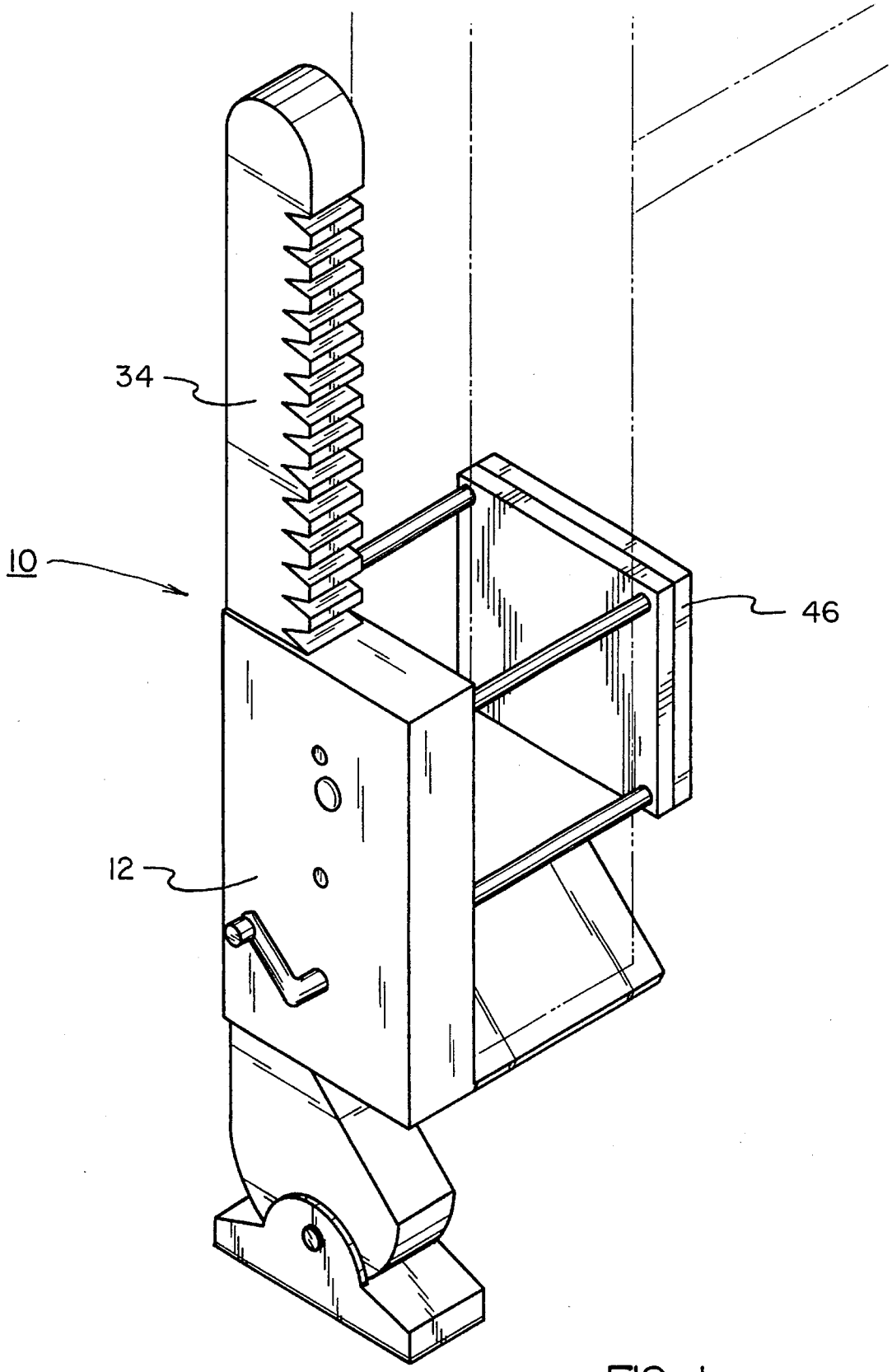
FIG. 1 is a perspective view of the preferred embodiment of the ladder leveling device constructed in accordance with the principles of the present invention.
Figure 2:
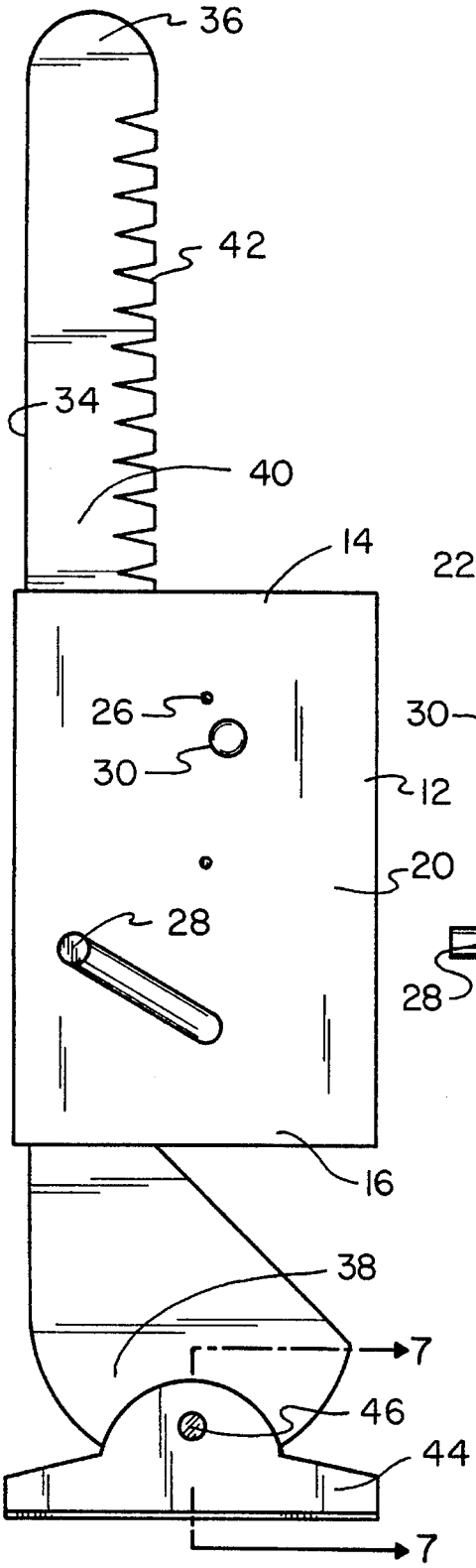
FIG. 2 is a side elevational view of the present invention.

With reference now to the drawings, and in particular, to FIG. 1 thereof, the preferred embodiment of the new and improved ladder leveling device embodying the principles and concepts of the present invention and generally designated by the reference number 10 will be described.

Specifically, it will be noted in the various Figures that the device relates to a new and improved ladder leveling device for adjusting the length of a ladder's leg to keep the ladder vertical on uneven ground. In its broadest context, the device consists of a gear box, a vertical rack, and an adjustable clamp.

Figure 3:
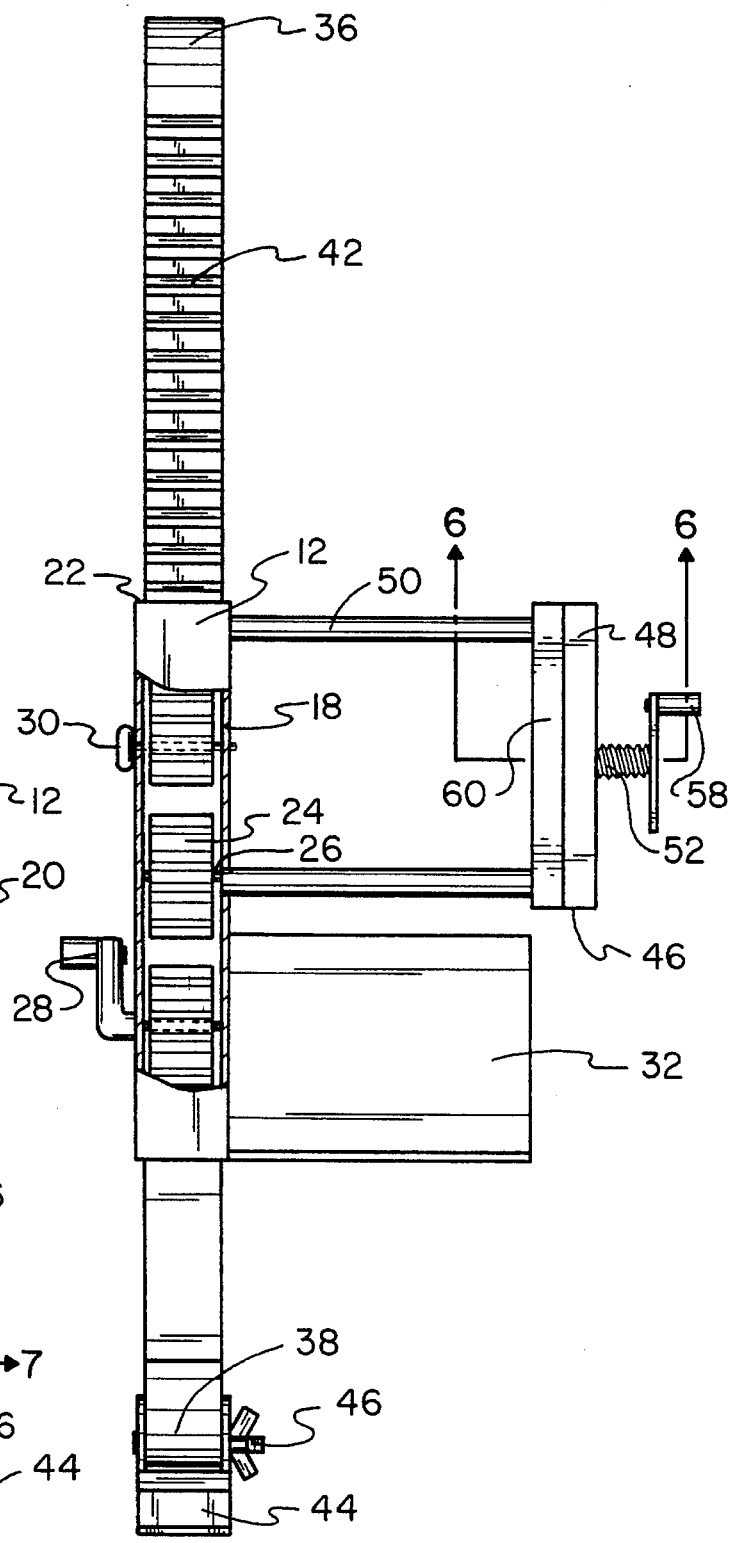
FIG. 3 is a front view of the present invention illustrating the exposed gears.
Figure 4:
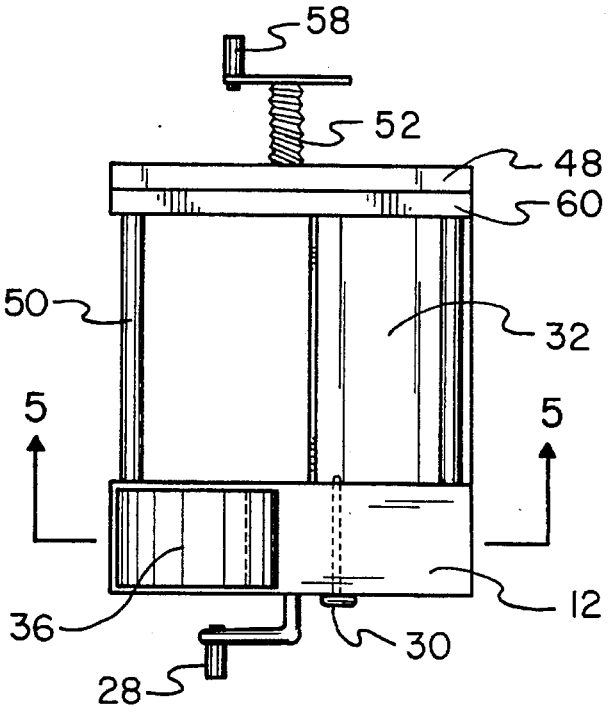
FIG. 4 is a plan view of the preferred embodiment of the present invention.
Figure 5:
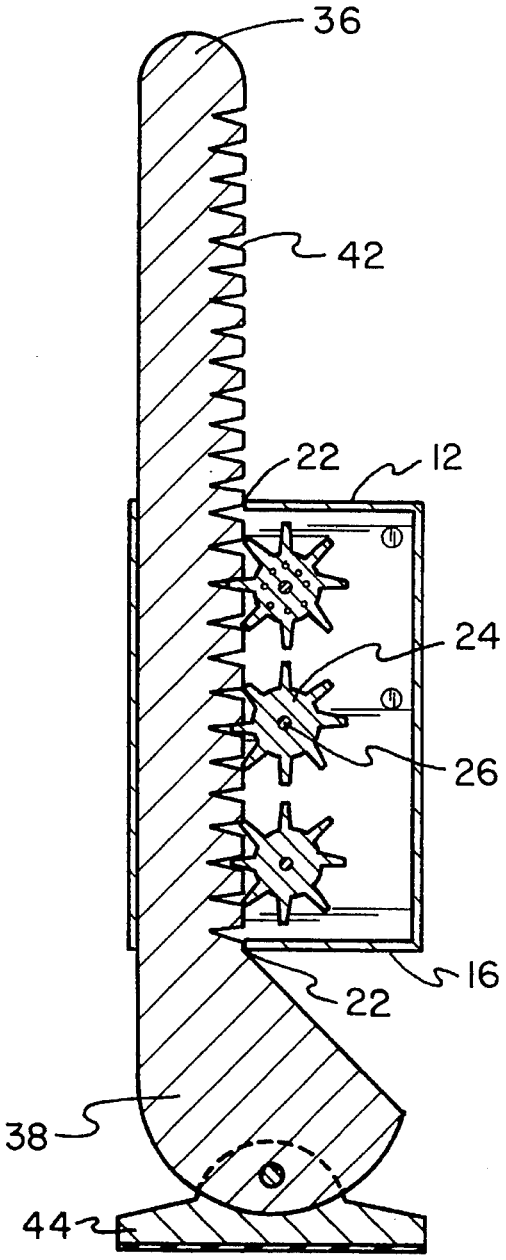
FIG. 5 is a cross-sectional view taken along line 5—5 of FIG. 4.

The device 10 contains a gear box 12 having an upper end 14, a lower end 16, a right wall 18 and a left wall 20. A receiving aperture 22 is formed through the upper end 14 and the lower end 16. As illustrated in FIG. 5, three gears 24 are coupled to an interior of the gear box 12 on shafts 26. The shaft 26 of a lowest gear 24 extends outwardly of the left wall 20. As seen in FIG. 3, a crank 28 couples with the outwardly extending shaft 26 of the lowest gear 24. The crank 28 serves to rotate the lowest gear 24 thereby collectively rotating the three gears 24. A pin 30 selectively couples with an uppermost gear 24 and extends outwardly of the left wall 20. The pin 30 serves to selectively engage or disengage the three gears 24. A plate 32 is secured to the a lower portion of the right wall 18. The plate 32 serves to support the ladder's leg.

Figure 7:
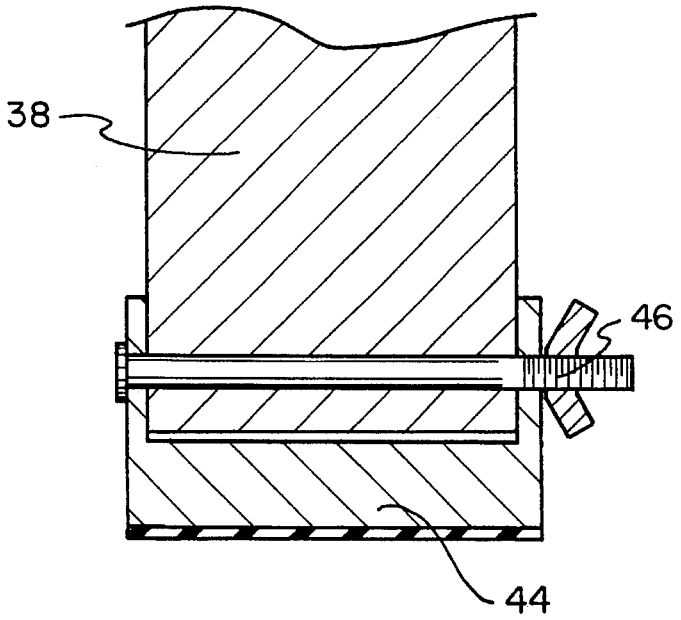
FIG. 7 is a cross-sectional view taken along line 7—7 of FIG. 2.

The device 10 contains a vertical rack 34 having a first end 36, a second end 38, an intermediate extent 40 therebetween, a front surface and a back surface. The front surface of the intermediate extent 40 has a plurality of teeth 42 thereon. The vertical rack 34 is secured within the receiving aperture 22 formed through the upper end 14 and the lower end 16 of the gear box 12. The plurality of teeth engage 42 the three gears 24 and are optionally raised or lowered by the rotation of the three gears 24 when the pin 30 is disengaged. As illustrated in FIG. 7, a foot pad 44 is pivotally coupled with the second end 38 by a bolt and wing nut 46. The foot pad 44 serves to lie flat on the ground and stabilize the device 10.

Figure 6:
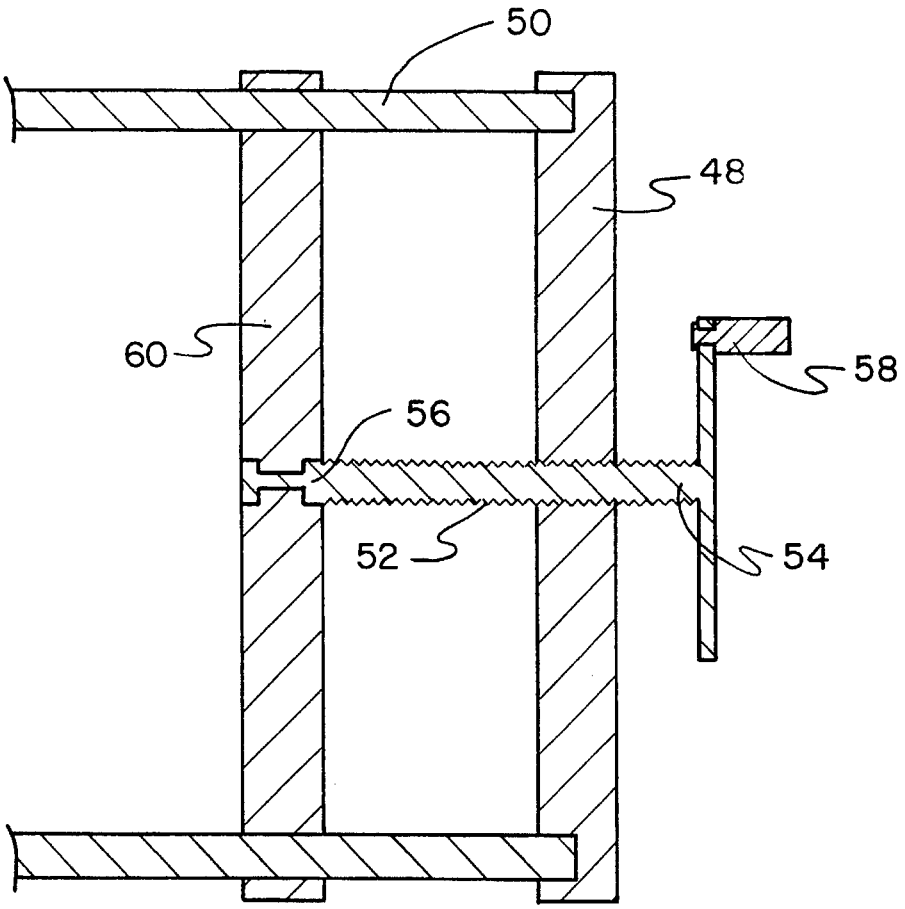
FIG. 6 is a cross-sectional view taken along line 6—6 of FIG. 3.

FIG. 6 illustrates an adjustable clamp 46 having an outer wall 48. The outer wall 48 has four inwardly extending posts 50 therefrom. The posts 50 are secured to the right wall 18 of the gear box 12 upwardly of the plate 32. The outer wall 48 has a threaded aperture formed therethrough. A crank shaft 52 is rotatably coupled with the threaded aperture of the outer wall 48. The crank shaft 52 has a first end 54 and a second end 56. The first end 54 has a crank handle 58 theresecured. The adjustable clamp 46 has a movable side wall 60. The movable side wall 60 is slidably coupled with the four inwardly extending posts 50. The movable side wall 60 also is secured to the second end 56 of the crank shaft 52.

The movable side wall 60 serves to secure the ladder's leg against the gear box 12.

FIG. 1 shows that the present invention is a mechanical device 10 which is slipped on the lower end of a ladder rail to adjust its length to keep the ladder vertical on uneven ground.

The device 10 utilizes a rack and pinion arrangement to adjust the length. It consists of a gear box 12 with a plate 32 at the bottom that supports the end of the ladder rail. The gears 24 are mounted on shafts 26 across the box 12, located to engage the teeth 42 on the vertical rack 34 which extends up through the box 12 along the back of the ladder rail. A foot pad 44 is pinned to the lower end of the rack 34 to allow it to lie flat on the ground even if it is pitched. A crank 28 is attached to the gear shaft 26. Two other gears 28, parallel to the drive gear, are idlers that engage the teeth 42 in the rack 34 for stability and support. The parts are made of steel, aluminum and plastic.

To place the ladder in the vertical position, the box 12 is placed under the lower end of the short rail against the plate 32 and set on the ground, resting on the pad 44 on the bottom. The crank 28 is used to turn the gear 24 to travel on the gear rack 34, elevating the box 12 until the rails are vertical. The gears 24 are then locked to hold the box in position.

Stepladders may require another unit on one of the three legs. This invention is easily applied to encourage that safe practices are followed when setting up ladders.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. A new and improved ladder leveling device for adjusting the length of a ladder's leg to keep the ladder vertical on uneven ground comprising, in combination:

a gear box having an upper end, a lower end, a right wall and a left wall, a receiving aperture formed through the upper end and the lower end, three gears coupled to an interior of the gear box on shafts, the shaft of a lowest gear extending outwardly of the left wall, a crank coupling with the outwardly extending shaft of the lowest gear, the crank serving to rotate the lowest gear thereby collectively rotating the three gears, a pin selectively coupling with an uppermost gear and extending outwardly of the left wall, the pin serving to selectively engage or disengage the three gears, a plate secured to the a lower portion of the right wall, the plate serving to support the ladder's leg;

a vertical rack having a first end, a second end, an intermediate extent therebetween, a front surface and a back surface, the front surface of the intermediate extent having a plurality of teeth thereon, the vertical rack secured within the receiving aperture formed through the upper end and the lower end of the gear box, the plurality of teeth engaging the three gears and optionally raised or lowered by the rotation of the three gears when the pin is disengaged, a foot pad pivotally coupled with the second end by a bolt and wing nut, the foot pad serving to lie flat on the ground and stabilize the device;

an adjustable clamp having an outer wall, the outer wall having four inwardly extending posts therefrom, the posts secured to the right wall of the gear box upwardly of the plate, the outer wall having a threaded aperture formed therethrough, a crank shaft rotatably coupled with the threaded aperture of the outer wall, the crank shaft having a first end and a second end, the first end having a crank handle theresecured, the adjustable clamp having a movable side wall, the movable side wall slidably coupled with the four inwardly extending posts, the movable side wall also secured to the second end of the crank shaft, the movable side wall serving to secure the ladder's leg against the gear box.

2. A new and improved ladder leveling device for adjusting the length of a ladder's leg to keep the ladder vertical on uneven ground comprising, in combination:

a gear box having a plurality of gears coupled to an interior of the gear box on shafts, the shaft of a lowest gear extending outwardly of the gear box, a crank coupling with the outwardly extending shaft of the lowest gear, the crank serving to rotate the lowest gear thereby collectively rotating the plurality of gears, a pin selectively coupling with an uppermost gear and extending outwardly of the left wall, the pin serving to selectively engage or disengage the three gears, a plate secured to the a lower portion of the gear box, the plate serving to support the ladder's leg;

a vertical rack having a plurality of teeth thereon, the vertical rack secured within the gear box, the plurality of teeth engaging the plurality of gears and optionally raised or lowered by the rotation of the gears when the pin is disengaged, a foot pad pivotally coupled with the vertical rack, the foot pad serving to lie flat on the ground and stabilize the device;

an adjustable clamp secured to a wall of the gear box upwardly of the plate, the clamp serving to secure the ladder's leg against the gear box.

3. The device as described in claim 2 and further including wherein the adjustable clamp further comprising an outer wall, the outer wall having four inwardly extending posts therefrom, the posts secured to the gear box upwardly of the plate, the outer wall having a threaded aperture formed therethrough, a crank shaft rotatably coupled with the threaded aperture of the outer wall, the crank shaft having a first end and a second end, the first end having a crank handle theresecured, the adjustable clamp having a movable side wall, the movable side wall slidably coupled with the four inwardly extending posts, the movable side wall also secured to the second end of the crank shaft, the movable side wall serving to secure the ladder's leg against the gear box.

* * * * *